US005332656A

United States Patent [19]

Bertoldi et al.

[11] Patent Number: 5,332,656

[45] Date of Patent: Jul. 26, 1994

[54] SILVER HALIDE COLOR PHOTOGRAPHIC LIGHT-SENSITIVE MATERIAL

[75] Inventors: Massimo Bertoldi, Fossano; Vinicio Busatto, Savona, both of Italy

[73] Assignee: Minnesota Mining and Manufacturing Company, St. Paul, Minn.

[21] Appl. No.: 34,726

[22] Filed: Mar. 22, 1993

[30] Foreign Application Priority Data

Apr. 7, 1992 [IT] Italy ..... MI92A00839

[51] Int. Cl.[5] ..... G03C 7/36

[52] U.S. Cl. ..... 430/544; 430/549; 430/557; 430/957

[58] Field of Search ..... 430/544, 549, 957

[56] References Cited

U.S. PATENT DOCUMENTS

| | | | |
|---|---|---|---|
| 3,617,291 | 11/1971 | Sawdey | 430/544 |
| 4,022,620 | 5/1977 | Okumura et al. | 430/389 |
| 4,477,563 | 10/1984 | Ichijima et al. | 430/544 |
| 4,524,130 | 6/1985 | Iwasa | 430/544 |
| 4,806,459 | 2/1989 | Makino et al. | 430/549 |
| 4,980,267 | 12/1990 | Taber | 430/549 |
| 5,006,452 | 4/1991 | Bucci | 430/544 |

FOREIGN PATENT DOCUMENTS

| | | |
|---|---|---|
| 356925 | 3/1990 | European Pat. Off. . |
| 070419 | 11/1990 | Japan . |
| 2099167 | 12/1982 | United Kingdom . |

*Primary Examiner*—Richard L. Schilling

*Attorney, Agent, or Firm*—Gary L. Griswold; Walter N. Kirn; Mark A. Litman

[57] ABSTRACT

Silver halide color photographic light-sensitive material which comprises a support having thereon at least one silver halide emulsion layer containing a) a diacylaminomethylene yellow dye forming coupler having bonded to the coupling active position a group which provides a compound having a development inhibiting property when the group is released from the coupler active position upon the color development reaction, wherein said group is a 4,7-dihalogen-2-benzotriazolyl group and b) an alkoxybenzoyl acetanilide yellow dye forming coupler having a 3-hydantoinyl leaving group bonded to the coupling active position.

3 Claims, No Drawings

SILVER HALIDE COLOR PHOTOGRAPHIC LIGHT-SENSITIVE MATERIAL

FIELD OF THE INVENTION

The present invention relates to a silver halide color photographic light-sensitive material containing a DIR (Development Inhibitor Releasing) coupler and a yellow dye forming coupler.

BACKGROUND OF THE ART

It is well known that color photographic light-sensitive materials using the subtractive process for color reproduction comprise silver halide emulsion layers selectively sensitive to blue, green and red light and associated with yellow, magenta and cyan dye forming couplers which form (upon reaction with an oxidized primary amine type color developing agent) the complementary color thereof. For example, an acylacetanilide or a pivaloylacetanilide type coupler is used to form a yellow color image; a pyrazolone, pyrazolotriazole, cyanacetophenone or indazolone type coupler is used to form a magenta color image; and a phenol type coupler, such as a phenol or naphthol coupler, is used to form a cyan color image.

In general, yellow color forming couplers have chemical structures in which one of the hydrogen atom of the active methylene group is substituted with a releasable atom or group. Examples of such releasable atoms or groups are a fluorine atom as described in U.S. Pat. No. 3,277,155, a phenoxy group as described in U.S. Pat. No. 3,408,194, an acyloxy group as described in U.S. Pat. No. 3,447,928, a sulfoxy group as described in U.S. Pat. No. 3,415,652, a group having a saccharin structure as described in U.S. Pat. No. 3,730,722 and a hydantoinyl group as described in U.S. Pat. Nos. 3,973,968; 4,022,620; 4,404,274; 4,777,123.

It is also known to incorporate into a lightsensitive color photographic material a compound capable of releasing a development inhibitor during development upon reaction with the oxidation product of a color developing agent. Typical examples of said compounds are the DIR (Development Inhibitor Releasing) couplers having a group having a development inhibiting property when released from the coupler introduced at the coupling position of the coupler. Examples of DIR couplers are described by C. R. Barr, J. R. Thirtle and P. W. Witturn, *Photographic Science and Eng.*, vol. 13. pp 74–80 (1969) and ibid. pp 214–217 (1969) or in U.S. Pat. Nos. 3,227,554, 3,615,506, 3,617,291, 3,701,783, 3,933,500, and 4,149,886.

The purpose of DIR couplers is to reduce grainines and improve sharpness of the image due to intralayer or intraimage effects (that is in the same layers or the same dye image) and improve color reproduction due to interlayer or interimage effects (that is in different layers or different dye images).

Among the DIR couplers, those having a benzotriazolyl development inhibitor releasing group are described in U.S. Pat. Nos. 3,617,291, 4,145,219 and 4,477,563, in GB Pat. Appln. 2,010,818, and in EP Pat. Appln. Nos. 115,302, 101,621 and 320,691.

EP Patent Application No. 356,925 describes a combination of a particular DIR coupler that enables release of the developed inhibitor moiety by means of a timing anchimeric release mechanism (DIAR coupler) with a particular alkoxybenzoyl acetanilide yellow dye-forming coupler comprising a phenoxy group or a heterocyclic ring as coupling off group. This combination is described as useful for improving both desired interimage effect and desired matching of reactivity.

Japanese patent Application No. 02-250,053 describes the combination of a malonodianilide DIR or DIAR coupler and a benzoyl acetanilide yellow coupler. The DIR couplers therein described comprise those having a benzotriazolyl group bonded to the coupling active position through the 1-nitrogen atom or through the 2-nitrogen atom of the benzotriazole group. This benzotriazole group does not possess any substituents at positions 4 and 7. The combination is described in this Patent Application as giving improved interimage effects.

Combinations of DIR couplers and yellow dye forming couplers have been described in GB Pat. Appln. 2,099,167 and U.S. patent application Ser. No. 4,022,620. Such combinations of yellow dye forming couplers and DIR couplers, however, have not been found to provide the desired match in reactivity and the desired interimage effect.

Accordingly, there is a continuing need to provide combinations of DIR couplers and yellow dye forming couplers which enable improved interimage effects.

SUMMARY OF THE INVENTION

The present invention relates to a silver halide color photographic light-sensitive material which comprises a support having thereon at least one silver halide emulsion layer containing a) a diacylaminomethylene development inhibitor releasing coupler having bonded to the coupling active position a 4,7-dihalogen-2-benzotriazolyl group and b) an alkoxybenzoyl acetanilide yellow dye forming coupler having a 3-hydantoinyl leaving group bonded to the coupling active position.

Said silver halide color light-sensitive material provides, upon exposure and development, color images of improved image quality.

DETAILED DESCRIPTION OF THE INVENTION

The present invention relates to a silver halide color photographic light-sensitive material which comprises a support having coated thereon at least one silver halide emulsion layer containing a) a diacylaminomethylene yellow dye forming coupler having, bonded directly to the coupling active position, a group which provides a compound having a development inhibiting property when the group is released from the coupler active position upon the color development reaction, wherein said group is a 4,7-dihalogen-2-benzotriazolyl group and b) an alkoxybenzoyl acetanilide yellow dye forming coupler having a 3-hydantoinyl leaving group bonded to the coupling active position.

In the present invention, said diacylaminomethylene yellow dye forming coupler may be represented by the general formula (I):

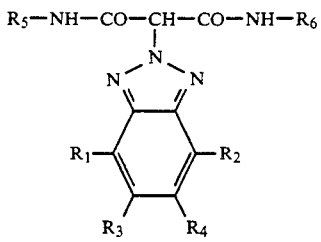

(I)

wherein $R_1$ and $R_2$, the same or different, each represents a halogen atom (chlorine, bromine, iodine and fluorine); $R_3$ and $R_4$, the same or different, each represents a hydrogen atom, a halogen atom (chlorine, bromine, iodine and fluorine), an amino group, an alkyl group having 1 to 4 carbon atoms (methyl, ethyl, buthyl, chloromethyl, trifluoromethyl, 2-hydroxyethyl, etc.), an alkoxy group having 1 to 4 carbon atoms (methoxy, chloromethoxy, ethoxy, butoxy, etc.), a hydroxy group, a cyano group, an aryloxy group (phenoxy, p-methoxyphenoxy, etc.), an acyloxy group (acyloxy, benzoyloxy, etc.), an acyl group (acyl, benzoyl, etc.), an alkoxycarbonyl group (methoxycarbonyl, butyloxycarbonyl, etc.), an aryloxycarbonyl group (benzoxycarbonyl, etc.), an acylamino group (acetamido, benzamido, etc.), an alkylsulfonyl group (methylsulfonyl, chloromethylsulfonyl, etc.), an arylsulfonyl group (phenylsulfonyl, naphthylsulfonyl, etc.), an alkoxysulfonyl group (ethoxysulfonyl, butoxysulfonyl, etc.), an aryloxysulfonyl group (phenoxysulfonyl, 2-methoxyphenoxysulfonyl, etc.) or an ureido group (phenylureido, butaneureido, etc). $R_5$ and $R_6$ each represents an alkyl group (of 1 to 20 carbon atoms) or an aryl group (of 6 to 20 carbon atoms, especially a phenyl group).

In the formula (I) above, the alkyl group represented by $R_5$ and R6 has preferably from 1 to 18 carbon atoms and may be substituted or unsubstituted. Preferred examples of substituents of the alkyl group include an alkoxy group, an aryloxy group, a cyano, an amino group, an acylamino group, a halogen atom, an hydroxy group, a carboxy group, a sulfo group, an heterocyclic group, etc. Practical examples of useful alkyl groups are an isopropyl group, an isobutyl group, a tertbutyl group, an isoamyl group, a tert-amyl group, a 1,1-dimethylbutyl group, a 1,1-dimethylhexyl group, a 1,1-diethylhexyl group, a 1,1-dimethyl-l-methoxyphenoxymethyl group, a 1,1-dimethyl-l-ethylthiomethyl group, a dodecyl group, a hexadecyl group, an octadecyl group, a cyclohexyl group, a 2-methoxyisopropyl group, a 2-phenoxyisopropyl group, an alpha-aminoisopropyl group, an alpha-succinimidoisopropyl group, etc.

When the term "group" is used to describe a chemical compound or substituent, the described chemical material includes the basic group and that group with conventional substitution. Where the term "moiety" is used to describe a chemical compound or substituent only an unsubstituted chemical material is intended to be included. For example, "alkyl group" includes not only such alkyl moieties as methyl, ethyl, octyl, stearyl, etc., but also such moieties bearing substituent groups such as halogen, cyano, hydroxyl, nitro, amine, carboxylate, etc. On the other hand, "alkyl moiety" includes only methyl, ethyl, octyl, stearyl, cyclohexyl, etc.

In particular, the diacylaminomethylene yellow dye forming coupler for use in the present invention is represented by the general formula (II):

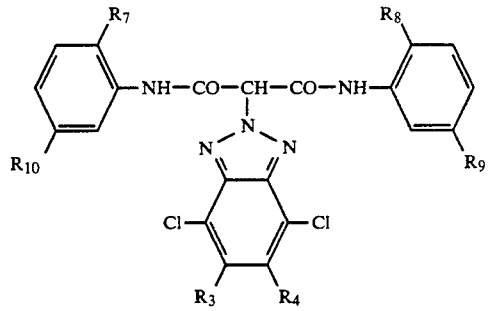

(II)

wherein $R_3$ and $R_4$ are the same as in Formula (I); $R_7$ and $R_8$ each represents a hydrogen atom or a halogen atom (chlorine, bromine, iodine and fluorine); $R_9$ and $R_{10}$ each represents a halogen atom, a nitro group, a cyano group, a thiocyano group, a hydroxy group, an alkoxy group (preferably having 1 to 15 carbon atoms, such as methoxy, isopropoxy, octyloxy, etc.), an aryloxy group (preferably having up to 20 carbon atoms, such as phenoxy, nitrophenoxy, etc.), an alkyl group (preferably having 1 to 15 carbon atoms, such as methyl, ethyl, dodecyl, etc.),an alkenyl group (preferably having 1 to 15 carbon atoms, such as allyl), an aryl group (preferably having up to 10 carbon atoms, e.g., 6 to 10 carbon atoms), such as phenyl, tolyl, etc.), an amino group (e.g. an unsubstituted amino group or an alkylamino group having 1 to 15 carbon atoms such as diethylamino, octylamino, etc.), a carboxy group, an acyl group (preferably having 2 to 16 carbon atoms such as acetyl, decanoyl, etc.), an alkoxycarbonyl group (preferably having the alkyl moiety of 1 to 20 carbon atoms, such as methoxycarbonyl, butoxycarbonyl, octyloxycarbonyl, dodecyloxycarbonyl, 2-methoxyethoxycarbonyl, etc.), an aryloxycarbonyl group (preferably having the aryl moiety of 6 to 20 carbon atoms, such as phenoxycarbonyl, tolyloxycarbonyl, tolyoxycarbonyl, etc.), a carbamoyl group (such as ethylcarbamoyl, octylcarbamoyl, etc.), an acylamino group (preferably having 2 to 21 carbon atoms, such as acetamido, octanamido, 2,4-ditert-pentylphenoxyacetamido, etc.), a sulfo group, an alkylsulfonyl group (preferably having 1 to 15 carbon atoms, such as methylsulfonyl, octylsulfonyl, etc.), an arylsulfonyl (preferably having 6 to 20 carbon atoms, such as phenylsulfonyl, octyloxyphenylsulfonyl, etc.), an alkoxysulfonyl (preferably having 1 to 15 carbon atoms, such as methoxysulfonyl, octyloxysulfonyl, etc.), an aryloxysulfonyl (preferably having 6 to 20 carbon atoms, such as phenoxysulfonyl, etc.), a sulfamoyl group (preferably having 1 to 15 carbon atoms, such as diethylsulfamoyl, octylsulfamoyl, methyloctadecylsulfamoyl, etc.), a sulfonamino group (preferably having 1 to 15 carbon atoms, such as methylsulfonamino, octylsulfonamino, etc.) and the like.

The total number of carbon atoms contributed by $R_9$ and $R_{10}$ is preferably from 6 to 35.

More in particular, the diacylaminomethylene yellow dye forming coupler for use in the present invention is represented by the general formula (III):

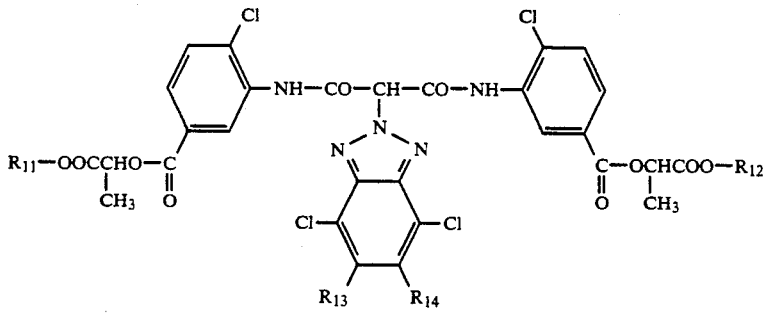
(III)
wherein $R_{11}$ and $R_{12}$ each represents an alkyl group, having 1 to 20 carbon atoms (such as methyl, ethyl, dodecyl, etc.), and $R_{13}$ and $R_{14}$ each represents a lower alkyl group, having 1 to 4 carbon atoms (such as methyl, ethyl, butyl, etc.).
Specific examples of yellow dye forming DIR couplers for use in the present invention are given below as illustrative examples.
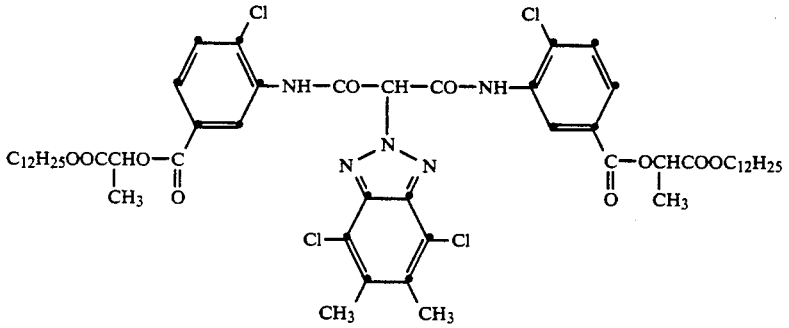
(1)
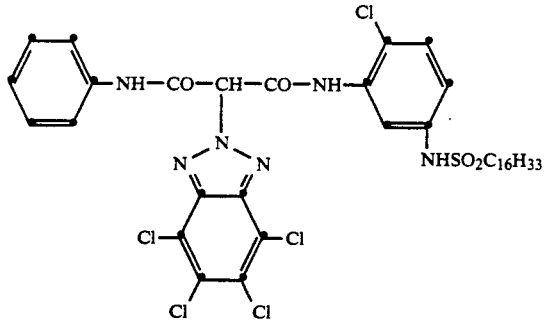
(2)
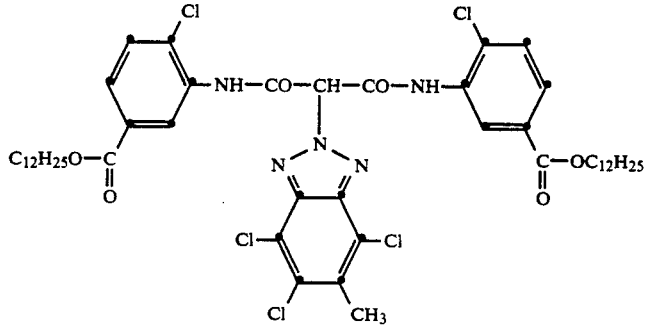
(3)

-continued
(4)
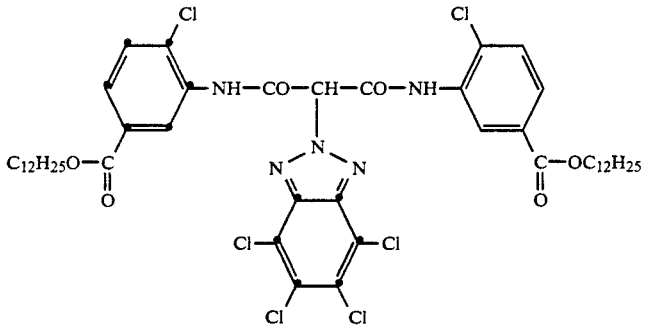
(5)
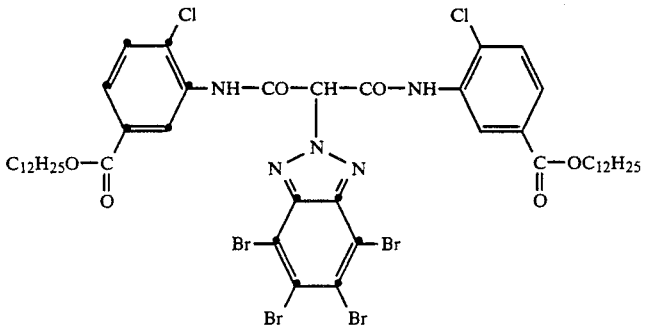
(6)
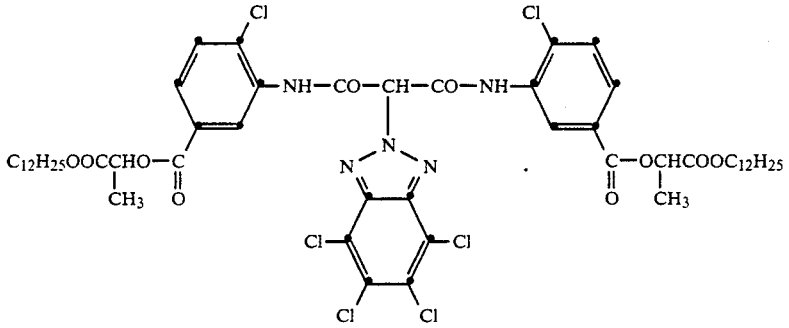
(7)
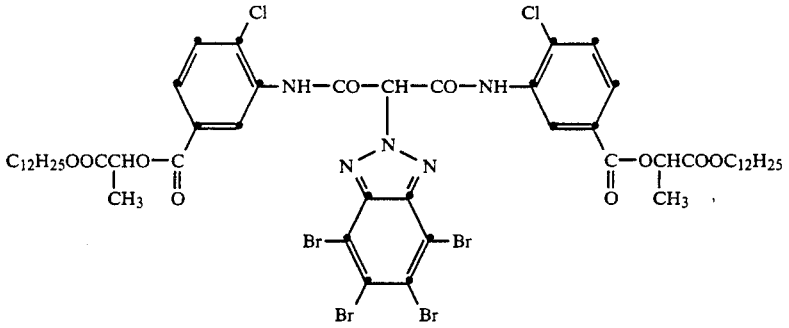
(8)
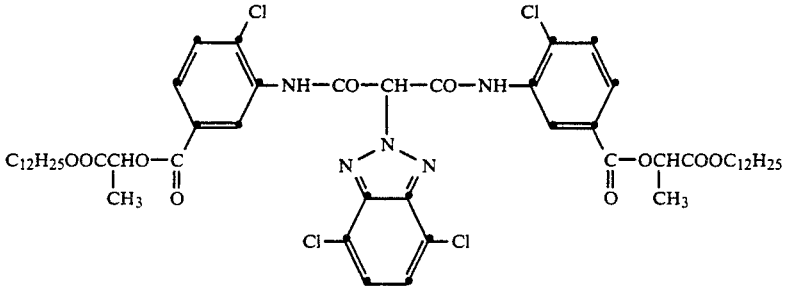

-continued
(9)
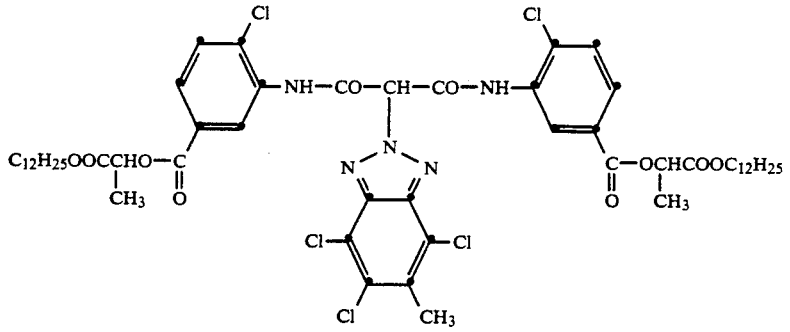
(10)
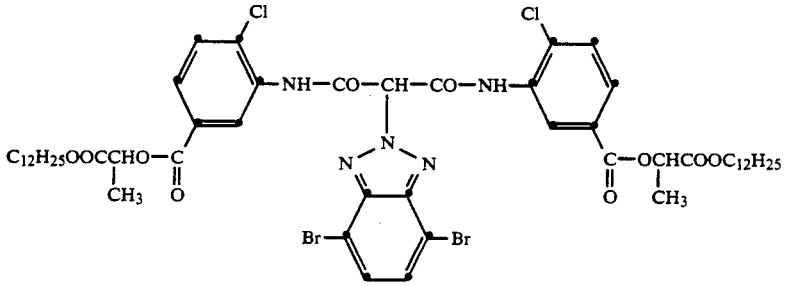
(11)
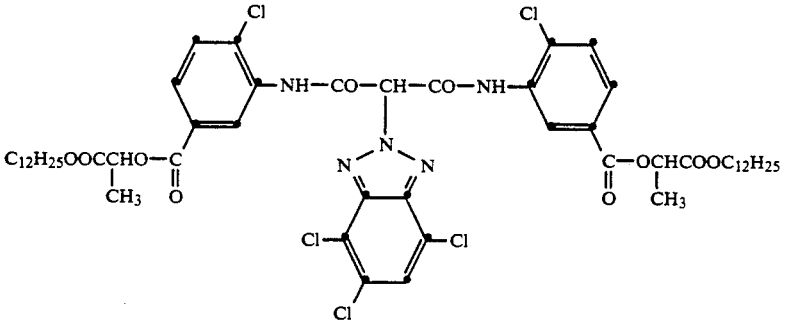
(12)
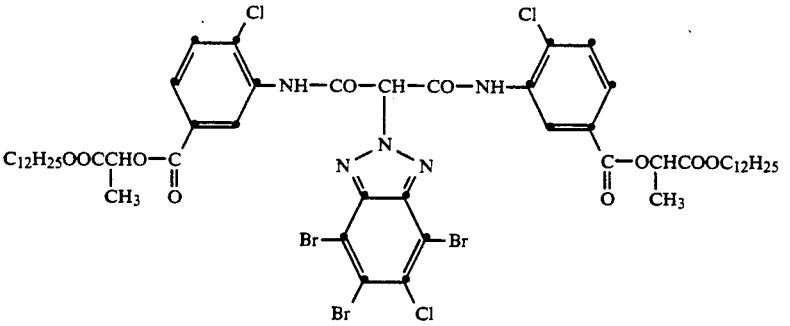
(13)
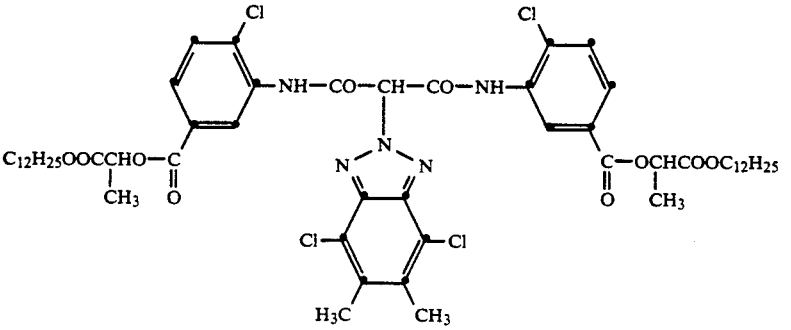

-continued (14)

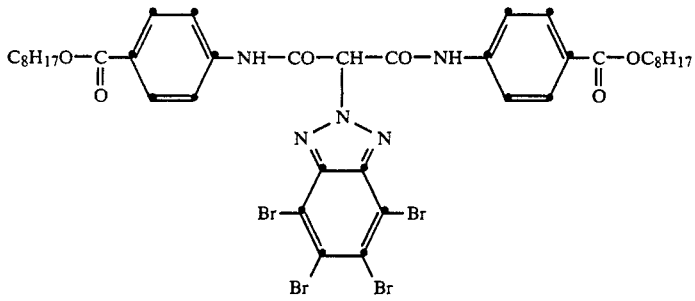

(15)

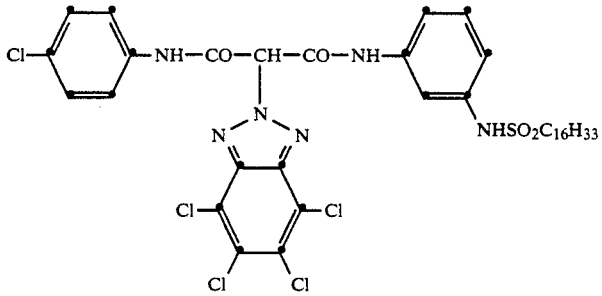

(16)

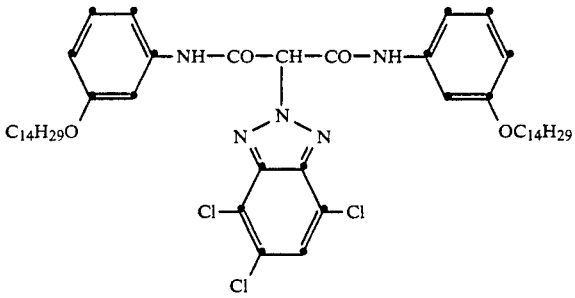

(17)

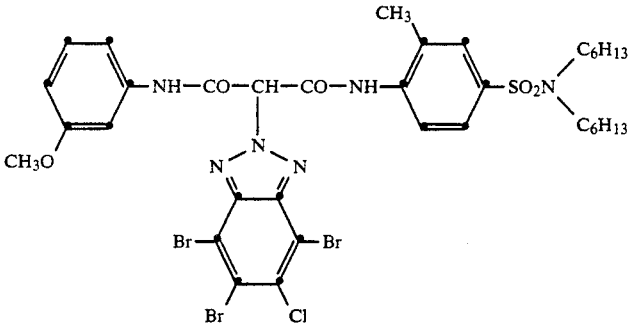

The DIR couplers for use in the present invention can be synthesized according to conventional means for synthesizing DIR couplers. A typical example of synthesis of the DIR couplers for use in the present invention is given below.

SYNTHESIS EXAMPLE 1

Synthesis of DIR coupler (1)

Bis-{N-2-chloro-5-(1-dodecyloxycarbonyl)-ethyloxycarbonylphenyl}-2-(5,6-dimethyl-4,7-dichlorobenzotriazol-2-yl)-malonodiamide To a solution of 7.5 g bis-{N-2-chloro-5-(1-dodecyloxycarbonyl)-ethyloxycarbonylphenyl}-malonodiamide in 30 cc of $CH_2Cl_2$ was added a solution of 1.5 gr bromine in 5 cc of $CH_2Cl_2$. After stirring for 3 hours, the organic solution was washed with water, dried over sodium sulfate and concentrated under vacuum. The oil obtained was diluted with 50 cc DMF and added to a suspension of 1.9 g 5,6-dimethyl-4,7-dichlorobenzotriazole, 1.7 g of $Na_2CO_3$ and 50 cc DMF. After stirring for two hours at room temperature, the solution was poored in a 100 cc of water acidified to pH1 with HCl. After standing overnight, a yellow crude product was collected. After crystallization from a solution acetonitrile/acetone, 6 g of pure product were obtained.

The structure of the above coupler was confirmed by elemental analysis, IR spectra and $^1H$ and $^{-}C$ spectra. The 2-nitrogen bond was confirmed also by Thermospray-Mass Spectroscopy analysis.

The yellow dye forming DIR couplers of the present invention can be hydrophilic couplers (Fischer type couplers) having a water-solubilizing group, for example a carboxy group, a hydroxy group, a sulfo group, etc., or hydrophobic couplers. As methods for adding the couplers to a hydrophilic colloid solution or to a gelatino-silver halide photographic emulsion or dispersing said couplers thereof, those methods conventionally known in the art can be applied. For example, hydrophobic couplers of the present invention can be dissolved in a high boiling water insoluble solvent and the resulting solution emulsified into an aqueous medium as described for example in U.S. Pat. Nos. 2,304,939, 2,322,027, etc., or said hydrophobic couplers are dissolved in said high boiling water insoluble organic solvent in combination with low boiling organic solvents and the resulting solution emulsified into the aqueous medium as described for example in U.S. Pat. Nos. 2,801,170, 2,801,171, 2,949,360, etc.

The alkoxybenzoyl acetanilide yellow dye forming coupler for use in the present invention may be represented by the general formula (VI):

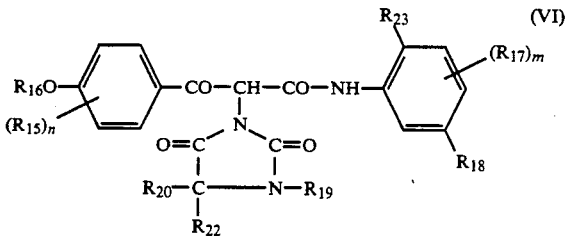

wherein $R_{15}$ and $R_{17}$ each represents an alkyl group (substituted or unsubstituted) having 1 to 4 carbon atoms (such as methyl, ethyl, propyl, butyl, chloromethyl, trifluoromethyl, etc.), aryl group (substituted or unsubstituted, preferably having 6 to 10 carbon atoms, such as phenyl, tolyl, benzyl, etc.), chloro atom, bromo atom or alkoxy group (preferably having 1 to 15 carbon atoms, such as methoxy, isopropoxy, octyloxy, etc.); m and n are individually 0, 1 or 2; $R_{16}$ is an alkyl group (substituted or unsubstitued) having 1 to 4 carbon atoms (such as methyl, ethyl, propyl, butyl, chloromethyl, trifluoromethyl, etc.); $R_{18}$ is a ballast group; $R_{19}$ represents a hydrogen atom, an alkyl group (substituted or unsubstitued, such as methyl, ethyl, propyl, isopropyl, amyl, isoamyl, hexyl, carboxymethyl, hexadecyl, etc.), an aryl group (substituted or unsubstitued, such as phenyl group and naphthyl group) or an acyl group (such as acetyl, propionyl, octanoyl, benzoyl, etc.); $R_{20}$ is hydrogen atom, an alkyl group (substituted or unsubstitued, such as methyl, ethyl, propyl, isopropyl, amyl, isoamyl, hexyl, carboxymethyl, hexadecyl, etc.), —O—$R_{21}$ or —S—$R_{21}$, wherein $R_{21}$ is hydrogen atom, an alkyl group (substituted or unsubstitued, such as methyl, ethyl, propyl, isopropyl, amyl, isoamyl, hexyl, carboxymethyl, hexadecyl, etc.), an aryl group (substituted or unsubstitued, such as phenyl group and naphthyl group), a hetrocyclic group bonded to the oxygen atom or to the sulfur atom through one carbon atom forming said hetrocyclic ring such as 2-tetrahydropyranyl group, a 2-pyridyl group or a 4-pyridyl group and the like, or an acyl group (such as acetyl, propionyl, octanoyl, benzoyl, etc.); $R_{22}$ is hydrogen atom, an alkyl group (substituted or unsubstitued, such as methyl, ethyl, propyl, isopropyl, amyl, isoamyl, exyl, carboxymethyl, hexadecyl, etc.), or an aryl group (substituted or unsubstitued, such as phenyl group and naphthyl group); $R_{23}$ is halogen atom (chlorine, bromine, iodine and fluorine) or an alkoxy group having 1 to 15 carbon atoms (methoxy, chloromethoxy, ethoxy, butoxy, etc.) group.

The ballasting group represented by $R_{18}$ in Formula (V) above acts as a "ballast" which can maintain the yellow coupler in a specific layer so as to substantially prevent said coupler from diffusing to any other layer in a multilayer color photographic element. The group has a sufficient bulkiness to complete that purpose. Usually a group having a hydrophobic group of 8 to 32 carbon atoms is introduced in the coupler molecule as ballasting group. Such group can be bonded to the coupler molecule directly or through an amino, ether, carbonamido, sulfonamido, ureido, ester, imido, carbamoyl, sulfamoyl, phenylene, etc., bond. Specific examples of ballasting groups are illustrated in U.S. Pat. No. 4,009,083, in European Pat. Nos. 87,930, 84,100, 87,931, 73,146, and 88,563, in German Pat. Nos. 3,300,412 and 3,315,012, in Japanese Pat. Nos. 58/33248, 58/33250, 58/31334, 58/106539. Preferably, such ballasting groups comprise alkyl chains, the total carbon atoms of which are no more than 20.

In particular, in the present invention, said alkoxybenzoyl acetandide yellow dye forming coupler is represented by the general formula (VII):

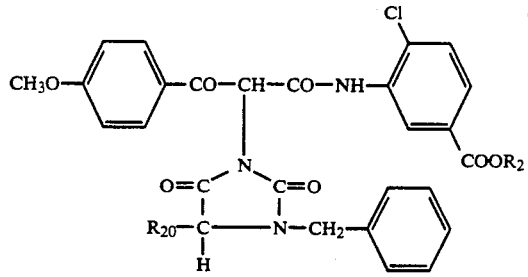

wherein $R_{20}$ is the same as in formula (VI) and $R_{24}$ is an alkyl group having 8 to 32 carbon.

Specific examples of alkoxybenzoyl acetanilide yellow dye forming couplers of the present invention are given below as illustrative examples.

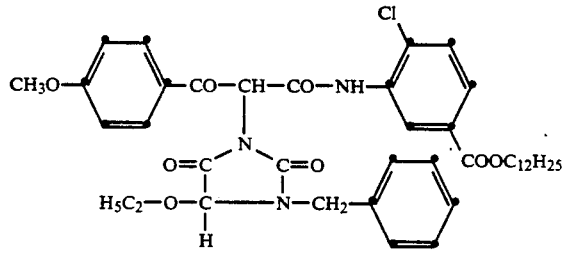

-continued
(2)
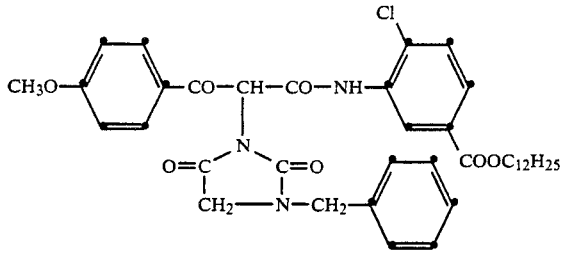
(3)
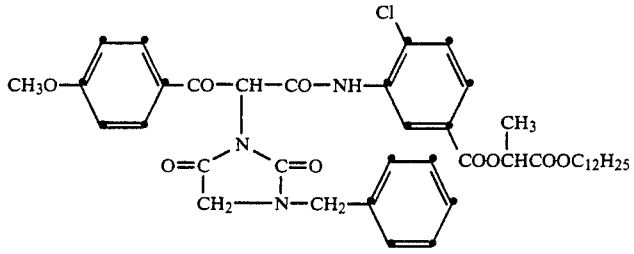
(4)
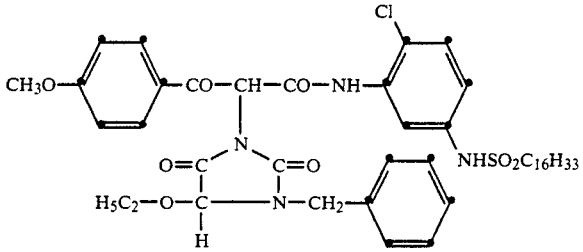
(5)
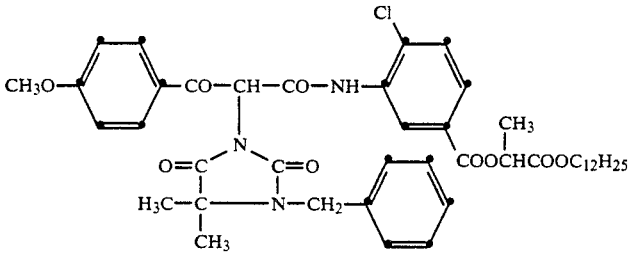
(6)
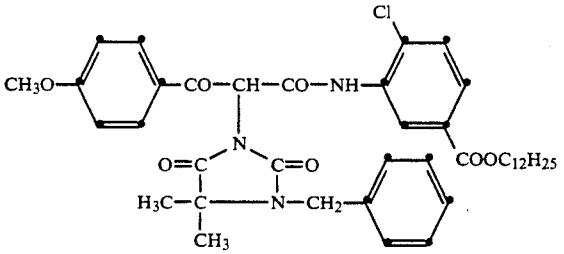
(7)
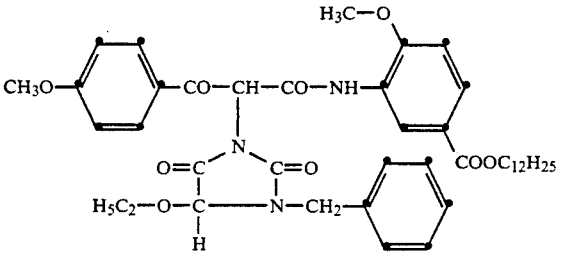

-continued (8)

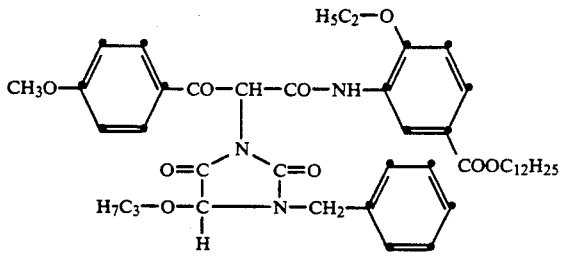

(9)

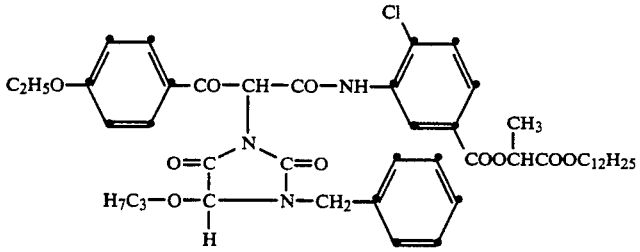

(10)

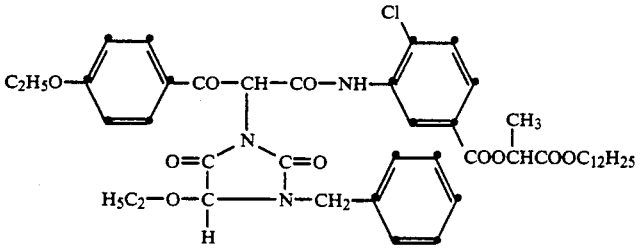

The yellow couplers for use in the present invention can be synthesised according to conventional means for synthesizing yellow couplers. For example yellow coupler 1 can be synthesized as described in Research Disclosure April 1979 No. 18053 p. 198.

The diacylaminomethylene yellow dye forming DIR coupler and the alkoxybenzoylacetanilide yellow dye forming coupler for use in the present invention are dispersed in the emulsion layer(s) in an amount in the range from 0.5 to 5 moles of the diacylaminomethylene yellow dye forming DIR coupler for 100 moles of the alkoxybenzoylacetanilide yellow dye forming coupler, preferably from 1.0 to 2.5 tools per 100 tools.

The photographic elements of the present invention are preferably multilayer color elements comprising a blue sensitive or sensitized silver halide emulsion layer associated with yellow dye-forming color couplers, a green sensitized silver halide emulsion layer associated with magenta dye-forming color couplers and a red sensitized silver halide emulsion layer associated with cyan dye-forming color couplers. Each layer can be comprised of a single emulsion layer or of multiple emulsion sub-layers sensitive to a given region of visible spectrum. When multilayer materials contain multiple blue, green or red sub-layers, there can be in any case relatively faster and relatively slower sub-layers.

The silver halide emulsion used in this invention may be a fine dispersion of silver chloride, silver bromide, silver chloro-bromide, silver iodo-bromide and silver chloro-iodo-bromide in a hydrophilic binder. As hydrophilic binder, any hydrophilic polymer of those conventionally used in photography can be advantageously employed including gelatin, a gelatin derivative such as acylated gelatin, graft gelatin, etc., albumin, gum arabic, agar agar, a cellulose derivative, such as hydroxyethyl-cellulose, carboxymethyl-cellulose, etc., a synthetic resin, such as polyvinyl alcohol, polyvinylpyrrolidone, polyacrylamide, etc. Preferred silver halides are silver iodo-bromide or silver iodo-bromo-chloride containing 1 to 20% mole silver iodide. The silver halide grains may have any crystal form such as cubic, octahedral, tabular or a mixed crystal form. The silver halide can have a uniform grain size or a broad grain size distribution. The size of the silver halide ranges from about 0.1 to about 5 μm. The silver halide emulsion can be prepared using a single-jet method, a double-jet method, or a combination of these methods and can be matured using, for instance, an ammonia method, a neutralization method, an acid method, etc. The emulsions which can be used in the present invention can be chemically and optically sensitized as described in Research Disclosure 17643, III and IV, Dec. 1978; they can contain optical brighteners, antifogging agents and stabilizers, filtering and antihalo dyes, hardeners, coating aids, plasticizers and lubricants and other auxiliary substances, as for instance described in Research Disclosure 17643, V, VI, VIII, X, XI and XII, Dec. 1978. The layers of the photographic emulsion and the layers of the photographic element can contain various colloids, alone or in combination, such as binding materials, as for instance described in Research Disclosure 17643, IX, Dec. 1978. The above described emulsions can be coated onto several support bases (cellulose triacetate, paper, resin-coated paper, polyester included) by adopting various methods, as described in Research Disclosure 17643, XV and XVII, Dec. 1978. The light-sensitive silver halides contained in the photographic elements of the present invention after exposure can be processed to form a visible image by associating the silver halide with an aqueous alkaline medium in the presence of a developing agent contained in the medium or in the element. Processing formulations and techniques are described in Research Disclosure 17643, XIX, XX and XXI, Dec. 1978.

The present invention will be now illustrated in greater detail by reference to the following examples.

EXAMPLE 1

A multilayer negative color film (Film A) was made by coating a subbed cellulose triacetate support base with layers in the following order:

Layer 1. Silver antihalation layer at a total silver coverage of 0.27 g/m$^2$ and a gelatin coverage of 1.33 g/m$^2$;

Layer 2. An intermediate layer containing 0.97 g/m$^2$ of gelatin;

Layer 3. Low sensitivity green-sensitive magenta dye forming silver halide emulsion layer comprising a blend consisting of 63% w/w of a low-sensitivity silver bromo iodide emulsion (having 2.5% silver iodide moles and a mean grain size of 0.18 μm) and 37% w/w of a medium-sensitivity silver chloro-bromo-iodide emulsion (having 7% silver iodide moles and 5% silver chloride moles and a mean grain size of 0.45 μm). The low and medium emulsions were both chemically sensitized with sulfur and gold compounds, added with stabilizers, antifogging agents and green spectral sensitizing dyes. The layer was coated at a total silver coverage of 1.35 g/m$^2$, gelatin coverage of 1.44 g/m$^2$, 0.503 g/m$^2$ of the magenta dye forming coupler A, 0.016 g/m$^2$ of the magenta dye forming DIR coupler B, 0.074 g/m$^2$ of the yellow colored magenta dye forming coupler C and 0.147 g/m$^2$ of the yellow colored magenta dye forming coupler D.

Layer 4. A more sensitive green sensitive magenta dye forming silver halide emulsion layer comprising a silver bromo-iodide emulsion (having 12% silver iodide moles and a mean grain size of 0.11 μm) at a silver coverage of 1.60 g/m$^2$ and a gelatin coverage of 1.03 g/m$^2$, chemically sensitized with sulfur and gold compounds, added with stabilizers and antifogging compounds. The layer was coated with 0.498 g/m$^2$ of the magenta dye forming coupler A, 0.016 g/m$^2$ of the magenta dye forming DIR coupler B, 0.021 g/m$^2$ of the yellow colored magenta dye forming coupler C and 0.042 g/m$^2$ of the yellow colored magenta dye forming coupler D.

Layer 5. An intermediate layer containing 1.06 g/m$^2$ of gelatin;

Layer 6. Yellow colloidal silver filter layer at a total silver coverage 0.048 g/m$^2$ and a gelatin coverage of 1.18 g/m$^2$, comprising a dichloro-hydroxy-triazine gelatin hardener.

Layer 7. Low sensitivity blue sensitive yellow dye forming silver halide emulsion layer comprising a blend of 60% w/w of a low-sensitivity silver bromo iodide emulsion (having 2.5% silver iodide moles and a mean grain size of 0.18 μm) and 40% w/w of a silver chloro-bromo-iodide emulsion (having 7% silver iodide moles and 5% silver chloride moles and a mean grain size of 0.45 μm) at a total silver coverage of 0.51 g/m$^2$ and a gelatin coverage of 1.59 g/m$^2$. The low and medium sensitivity emulsions were both chemically sensitized with sulfur and gold compounds, added with stabilizers, antifogging agents and blue spectral sensitizing dyes. The layer was coated with 1.027 g/m$^2$ of yellow dye forming coupler 1 and 0.029 g/m$^2$ of yellow dye forming DIR coupler 1.

Layer 8. A more sensitive blue sensitive yellow dye forming silver halide emulsion layer comprising a silver bromo-iodide emulsion (having 12% silver iodide moles and a mean grain size of 0.11 μm) at a silver coverage of 0.90 g/m$^2$ and a gelatin coverage of 1.24 g/m$^2$, chemically sensitized with sulfur and gold compounds, added with stabilizers and antifogging compounds and blue spectral sensitizing dyes. The layer was coated with 0.829 g/m$^2$ of yellow dye forming coupler 1 and 0.023 g/m$^2$ of yellow dye forming DIR coupler 1.

Layer 9. First protective gelatin layer comprising gelatin at a coverage of 1.28 g/m$^2$;

Layer 10. Second protective gelatin layer comprising of gelatin hardener (dichlorohydroxytriazine) and matting agent (polymethylmethacrylate).

EXAMPLE 2

Comparison

A control multilayer negative color film (Film B) was made by coating a subbed cellulose triacetate support base as in Example 1, but the yellow dye forming DIR coupler 1 in layers 7 and 8 was replaced by equimolecular amounts of the yellow dye forming DIR coupler E.

EXAMPLE 3

Comparison

A control multilayer negative color film (Film C) was made by coating a subbed cellulose triacetate support base as in Example 1, but the alkoxy benzoyl acetanilide type yellow dye forming coupler 1 in layers 7 and 8 was replaced by equimolecular amounts of the pivaloyl type yellow dye forming coupler F.

EXAMPLE 4

Comparison

A control multilayer negative color film (Film D) was made by coating a subbed cellulose triacetate support base as in Example 3, but the yellow dye forming DIR coupler 1 in layers 7 and 8 was replaced by equimolecular amounts of the yellow dye forming DIR coupler E.

Samples of each film were exposed to a light source having a color temperature of 5,500 Kelvin through a WRATTEN TM W99 filter and an optical step wedge (selective exposure). Other samples of each film were exposed as above but without using any filter (white light exposure). All the exposed samples were developed in a standard type C41 process as described in *British Journal of Photography*, Jul. 12, 1974, pp. 597–598. Contrasts of the obtained sensitometric curves for selective exposures (gammas) and white light exposures (gainmaw were measured in the low dye-density or toe region (B1) and in the high dye-density or shoulder region (B2) of each sensitometric curve. Table 1 reports the values of

TABLE 1

| Film | R (B1) | R (B2) |
|---|---|---|
| A (Invention) | 41.7 | 36.2 |
| B (Comparison | 33.3 | 26.0 |
| C (Comparison) | 17.0 | 30.0 |
| D (Comparison) | 17.0 | 27.6 |

$$R = \frac{gamma_s - gamma_w}{gamma_w} \times 100$$

The higher the R numbers, the better are the interimage effects. The film A comprising the combination of a yellow dye forming coupler and a yellow dye forming DIR coupler, according to the present invention, shows improved interimage effects with respect to the comparison films B, C and D, wherein at least one of yellow dye forming coupler or of the yellow dye forming DIR coupler used in film A is not present.

Magenta dye forming Coupler A:

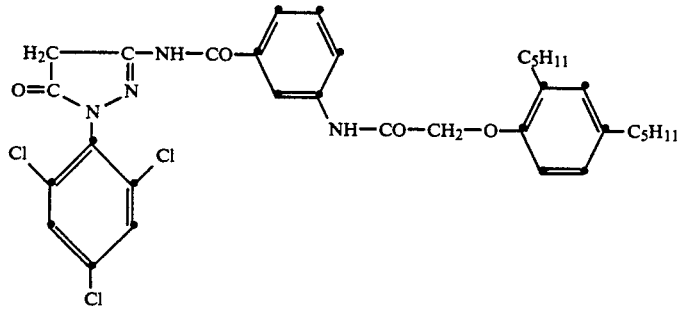

Magenta dye forming DIR Coupler B:

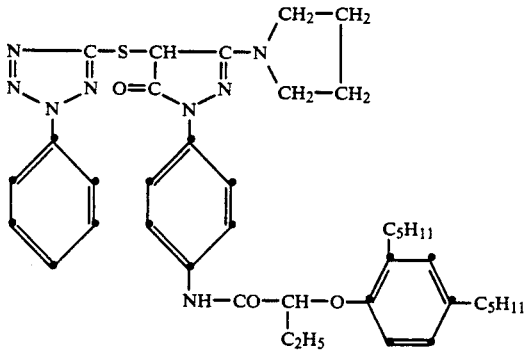

Yellow coloured magenta dye forming Coupler C:

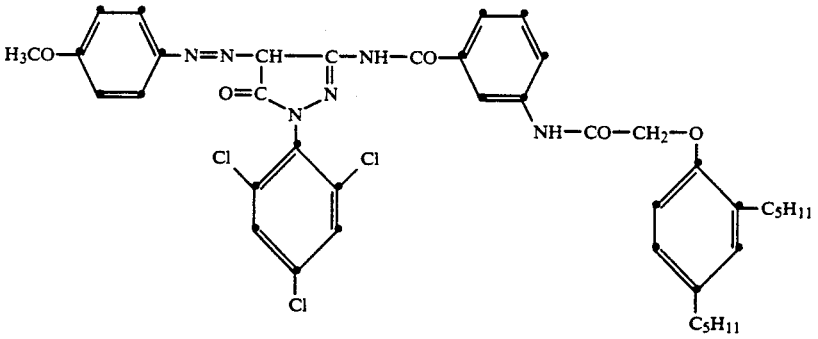

Yellow coloured magenta dye forming Coupler D:

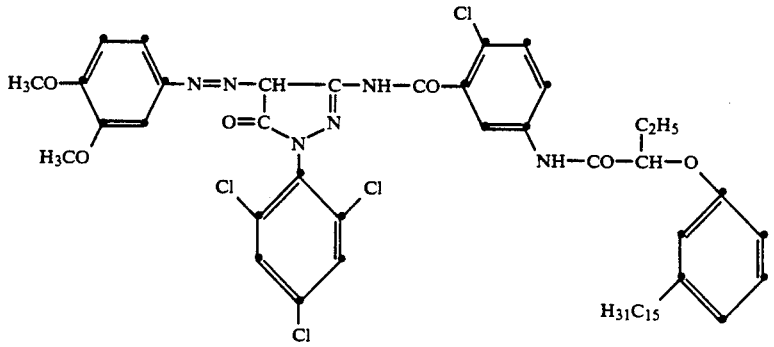

Yellow dye forming DIR Coupler E:

-continued

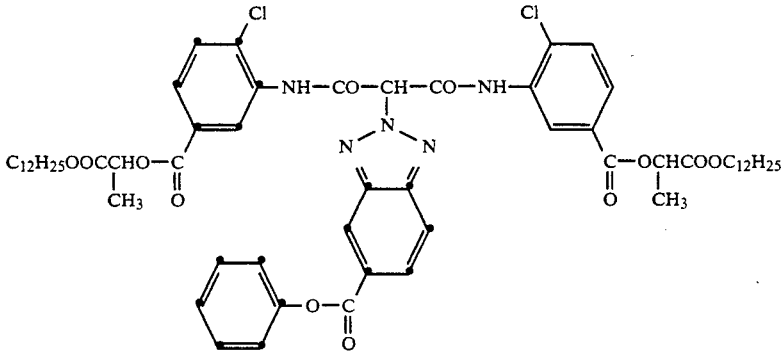

Yellow dye forming Coupler F:

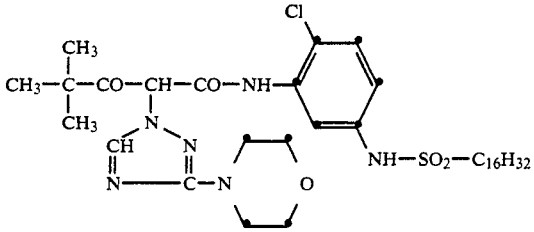

EXAMPLE 5

Film E was prepared by coating a cellulose triacetate support base, subbed with gelatin, with the following layers in the following order:

(a) a layer of black colloidal silver dispersed in gelatin having a silver coverage of 0.27 g/m$^2$ and a gelatin coverage of 1.33 g/m$^2$;

(b) an intermediate layer containing 0.97 g/m$^2$ of gelatin;

(c) a layer of low sensitivity red-sensitive silver halide emulsion comprising a low-sensitivity silver bromoiodide emulsion (having 2.5% silver iodide moles and a mean grain size of 0.18 μm) at a total silver coverage of 0.71 g/m$^2$ and a gelatin coverage of 0.94 g/m$^2$, containing the cyan-dye forming coupler G at a coverage of 0.354 g/m$^2$, the cyan-dye forming DIR coupler H at a coverage of 0.024 g/m$^2$ and the magenta colored cyan-dye forming coupler I at a coverage of 0.043 g/m$^2$, dispersed in a mixture of tricresylphosphate and butylacetanilide;

(d) a layer of medium-sensitivity red-sensitive silver halide emulsion comprising a silver chloro-bromo-iodide emulsion (having 7% silver iodide moles and 5% silver chloride moles and a mean grain size of 0.45 μm) at a silver coverage of 0.84 g/m$^2$ and a gelatin coverage of 0.83 g/m$^2$, containing the cyan-dye forming coupler G at a coverage of 0.333 g/m$^2$, the cyan-dye forming DIR coupler H at a coverage of 0.022 g/m$^2$ and the magenta colored cyan-dye forming coupler I at a coverage of 0.052 g/m$^2$, dispersed in a mixture of tricresylphosphate and butylacetanilide;

(e) a layer of high-sensitivity red-sensitive silver halide emulsion comprising a silver bromo-iodide emulsion (having 12% silver iodide moles and a mean grain size of 0.11 μm) at a silver coverage of 1.54 g/m$^2$ and a gelatin coverage of 1.08 g/m$^2$, containing two cyan-dye forming couplers, the coupler G at a coverage of 0.224 g/m$^2$ and the coupler J at a coverage of 0.032 g/m$^2$, and the cyan-dye forming DIR coupler H at a coverage of 0.018 g/m$^2$, dispersed in a mixture of tricresylphosphate and butylacetanilide;

(f) an intermediate layer containing 1.11 g/m$^2$ of gelatin, comprising a dichlorohydroxytriazine gelatin hardener;

(g) a layer of low sensitivity green sensitive silver halide emulsion comprising a blend of 63% w/w of the low-sensitivity emulsion of layer c) and 37% w/w of the medium-sensitivity emulsion of layer (d) at a silver coverage of 1.44 g/m$^2$ and a gelatin coverage of 1.54 g/m$^2$, containing the magenta-dye forming coupler A, at a coverage of 0.537 g/m$^2$, the magenta dye forming DIR coupler B at a coverage of 0.017 g/m$^2$, and the yellow colored magenta dye forming coupler C at a coverage of 0.079 g/m$^2$, the yellow coloured magenta dye forming coupler D at a coverage of 0.157 g/m$^2$, and dispersed in tricresylphosphate;

(h) a layer of high-sensitivity green sensitive silver halide emulsion comprising the emulsion of layer (e) at a silver coverage of 1.60 g/m$^2$ and a gelatin coverage of 1.03 g/m$^2$ containing the magenta dye forming coupler A, at a coverage of 0.498 g/m$^2$, the magenta dye forming DIR coupler B at a coverage of 0.016 g/m$^2$, the yellow coloured magenta dye forming coupler C at a coverage of 0.021 g/m$^2$, and the yellow colored magenta dye forming coupler D at a coverage of 0.043 g/m$^2$, dispersed in tricresylphosphate;

(i) an intermediate layer containing 1.06 g/m$^2$ of gelatin;

(j) a yellow filter layer containing 1.18 g/m$^2$ of gelatin, comprising a dichlorohydroxytriazine gelatin hardener;

(k) a layer of low-sensitivity blue-sensitive silver halide emulsion comprising a blend of 60% w/w of the low-sensitivity emulsion of layer c) and 40% w/w of the medium-sensitivity emulsion of layer (d) at a silver coverage of 0.53 g/m$^2$ and a gelatin coverage of 1.65 g/m$^2$ and the yellow dye forming coupler 1 at a coverage of 1.042 g/m$^2$ and the yellow dye forming DIR coupler 1 at a coverage of 0.028 g/m$^2$ dispersed in a mixture of diethyllaurate and dibuthylphthalate;

(l) a layer of high-sensitivity blue sensitive silver halide emulsion comprising the emulsion of layer (e) at a silver coverage of 0.90 g/m$^2$ and a gelatin coverage of 1.24 g/m$^2$, containing the yellow dye-forming coupler 1 at a coverage of 0.791 g/m$^2$ and the yellow dye forming DIR coupler 1 at a coverage of 0.021 g/m$^2$ dispersed in a mixture of diethyllaurate and dibuthylphthalate;

(m) a protective layer of 1.28 g/m$^2$ of gelatin; and (n) a top coat layer of 0.73 g/m$^2$ of gelatin containing 0.273 g/m$^2$ of polymethylmethacrylate beads, and dichlorohydroxytriazine hardener.

EXAMPLE 6

Film F was prepared by coating a cellulose triacetate support base, subbed with gelatin, as in Example 5, but the yellow dye forming DIR coupler 1 of layer (k) and layer (I) is replaced by the equimolecular amounts of the yellow dye forming DIR coupler 9.

EXAMPLE 7

Comparison

Film G was prepared by coating a cellulose triacetate support base, subbed with gelatin, as in Example 5, but the yellow dye forming DIR coupler 1 of layer (k) and layer (l) is replaced by the equimolecular amounts of the yellow dye forming DIR coupler E.

EXAMPLE 8

Comparison

Film H was prepared by coating a cellulose triacetate support base, subbed with gelatin, as in Example 5, but the yellow dye forming DIR coupler 1 of layer (k) and layer (l) is replaced by the equimolecular amounts of the yellow dye forming DIR coupler K.

Cyan dye forming coupler G:

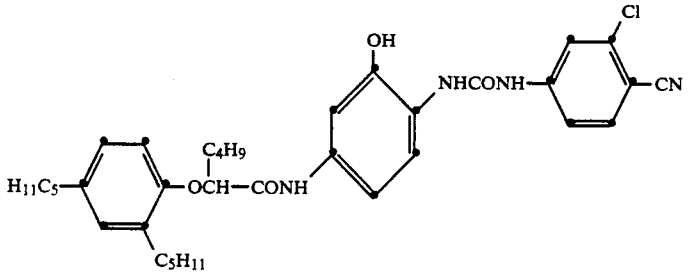

Cyan-dye forming DIR coupler H:

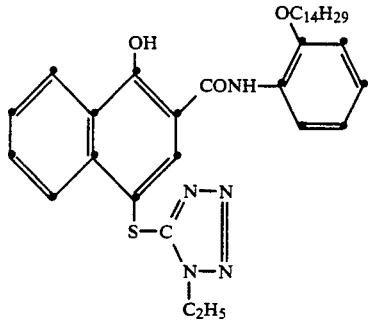

Magenta coloured cyan-dye forming coupler I:

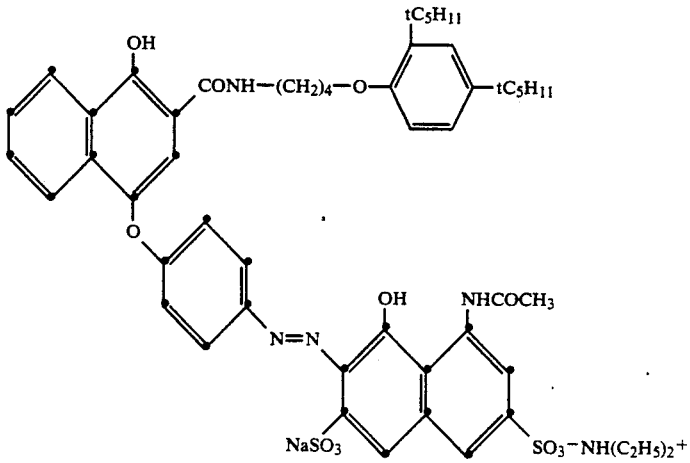

Cyan dye forming coupler J:

-continued

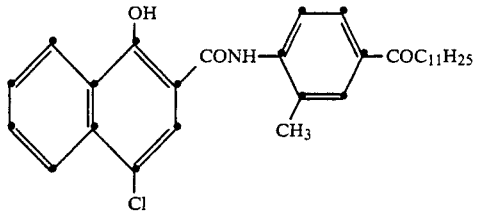

Yellow dye forming DIR Coupler K:

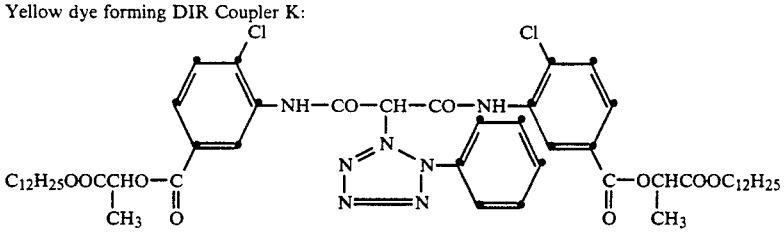

Samples of each film were exposed to a light source having a color temperature of 5,500 Kelvin through a WRATTEN TM W99 filter and an optical step wedge (selective exposure). Other samples of each film were exposed as above but without using any filter (white light exposure). All the exposed samples were developed in a standard type C41 process as described in *British Journal of Photography,* Jul. 12, 1974, pp. 597–598. Contrasts of the obtained sensitometric curves for selective exposures (gammas) and white light exposures (gainmaw) were measured in the low dye-density or toe region (B1) and in the high dye-density or shoulder region (B2) of each sensitometric curve. Table 2 reports the values of

TABLE 2

| Film | R (B1) | R (B2) |
|---|---|---|
| E (Invention) | 28.4 | 34.3 |
| F (Invention) | 33.8 | 31.9 |
| G (Comparison) | 30.0 | 22.4 |
| H (Comparison) | 29.1 | 25.0 |

$$R = \frac{gamma_s - gamma_w}{gamma_w} \times 100$$

The higher the R numbers, the better are the interimage effects. The films E and F of the present invention show improved interimage effects with respect to the comparison films G and H, particularly referring to the shoulder region (B2 values). In fact, in Table 2 the high B2 values of the films of the invention and the very low B2 values of the comparison films are notable. This is a consequnce of the fact that in the comparison films G and H, a combination including a yellow dye forming coupler of the present invention and a yellow dye forming DIR coupler not useful in the present invention has been used.

We claim:

1. A silver halide color photographic light-sensitive material which comprises a support having coated thereon at least one silver halide emulsion layer containing a) a diacylaminomethylene yellow dye forming coupler having, bonded directly to the coupling active position, a group which provides a compound having a development inhibiting property when the group is released from the coupler active position upon the color development reaction, wherein said group is a 4,7-dihalogen-2-benzotriazolyl group and b) an alkoxybenzoyl acetanilide yellow die forming coupler having a 3-hydantoinyl leaving group bonded to the coupling active position, wherein said alkoxybenzoyl acetanilide yellow dye forming coupler is represented by the general formula (VI):

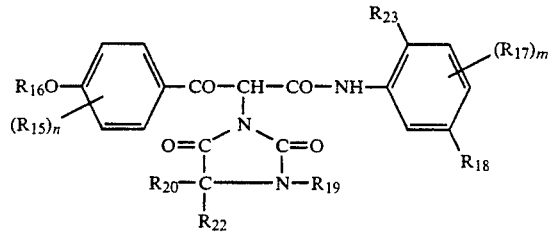

wherein $R_{15}$ and $R_{17}$ each represents an alkyl group of 1 to 4 carbon atoms, a phenyl or naphthyl group, chloro atom, bromo atom or alkoxy group of 1 to 4 carbon atoms; m and n are individually 0, 1 or 2; $R_{16}$ is an alkyl group of 1 to 4 carbon atoms; $R_{18}$ is a ballast group; $R_{19}$ represents a hydrogen atom, an alkyl group of 1 to 6 carbon atoms, a phenyl or naphthyl group or an acyl group; $R_{20}$ is an alkoxy group of 1 to 16 carbon atoms; $R_{22}$ is hydrogen atom, an alkyl group of 1 to 16 carbon atoms or a phenyl or naphthyl group; $R_{23}$ is a halogen atom, and wherein said diacylaminomethylene yellow dye forming coupler is represented by the general formula (III):

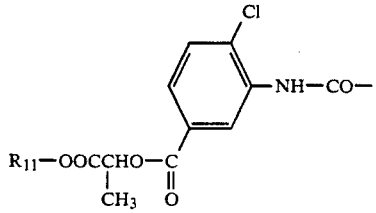

(III)

-continued

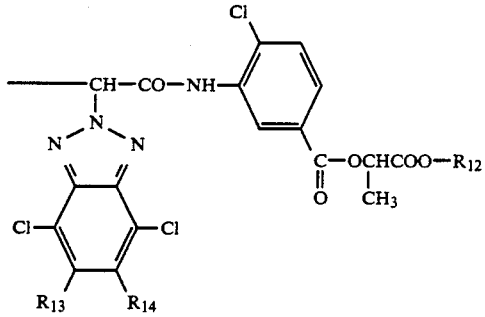

wherein $R_{11}$ and $R_{12}$ each represents an alkyl group having 1 to 20 carbon atoms, and $R_{13}$ and $R_{14}$ each represents a lower alkyl group having 1 to 4 carbon atoms.

2. A silver halide color photographic light-sensitive material which comprises a support having coated thereon at least one silver halide emulsion layer containing a) a diacylaminomethylene yellow dye forming coupler having, bonded directly to the coupling active position, a group which provides a compound having a development inhibiting property when the group is released from the coupler active position upon the color development reaction, wherein said croup is a 4,7-dihalogen-2-benzotriazolyl group and b) an alkoxybenzoyl acetanilide yellow dye forming coupler having a 3-hydantoinyl leaving group bonded to the coupling active position, wherein said alkoxybenzoyl acetanilide yellow dye forming coupler is represented by the formula (VIII):

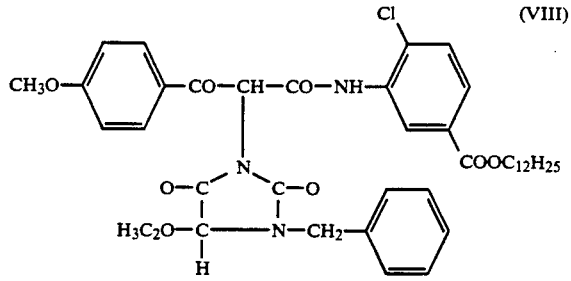

(VIII)

3. A silver halide color photographic light-sensitive material which comprises a support having coated thereon at least one silver halide emulsion layer containing a) a diacylaminomethylene yellow dye forming coupler having, bonded directly to the coupling active position, a group which provides a compound having a development inhibiting property when the group is released from the coupler active position upon the color development reaction, wherein said group is a 4,7-dihalogen-2-benzotriazolyl group and b) an alkoxybenzoyl acetanilide yellow dye forming coupler having a 3-hydantoinyl leaving group bonded to the coupling active position, wherein said diacylaminomethylene yellow dye forming coupler is represented by the formula (IV) or by the formula (V):

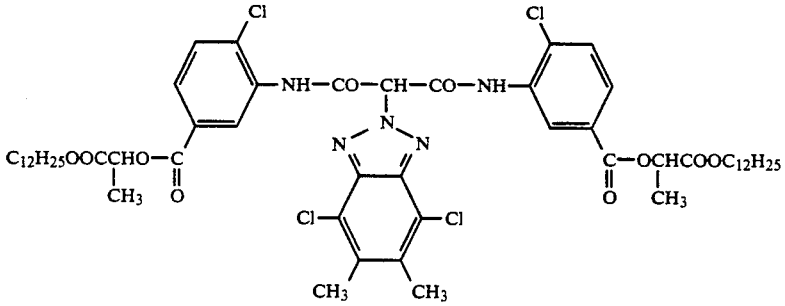

(IV)

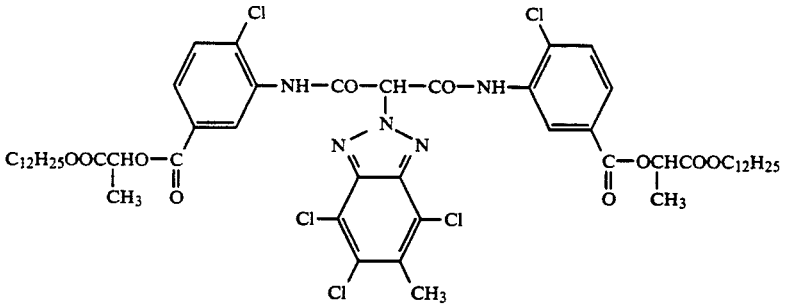

(V)

and wherein said alkoxybenzoyl acetanilide yellow dye forming coupler is represented by the formula (VIII):

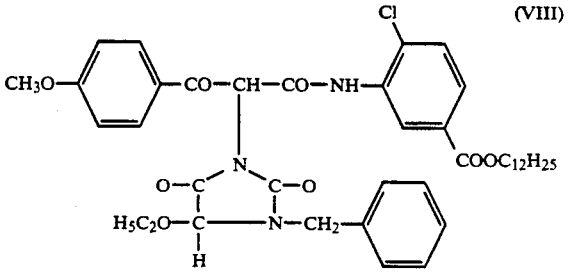

(VIII)

* * * * *

UNITED STATES PATENT AND TRADEMARK OFFICE

CERTIFICATE OF CORRECTION

PATENT NO. : 5,332,656

DATED : July 26, 1994

INVENTOR(S) : Bertoldi et al.

It is certified that error appears in the above-indentified patent and that said Letters Patent is hereby corrected as shown below:

Column 12, line 63, delete "and ¯C spectra"
and insert --and $^{13}C$ spectra--.

Column 14, line 36, delete "acetandide"
and insert --acetanilide--.

Column 17, line 46, delete "2.5 tools per 100 tools"
and insert --2.5 mols per 100 mols--.

Column 20, line 54, delete "gainmaw"
and insert --$gamma_w$--.

UNITED STATES PATENT AND TRADEMARK OFFICE

CERTIFICATE OF CORRECTION

PATENT NO. : 5,332,656

DATED : July 26, 1994

INVENTOR(S) : Bertoldi et al.

It is certified that error appears in the above-indentified patent and that said Letters Patent is hereby corrected as shown below:

Column 27, second formula, delete:

"Yellow dye forming DIR Coupler K:

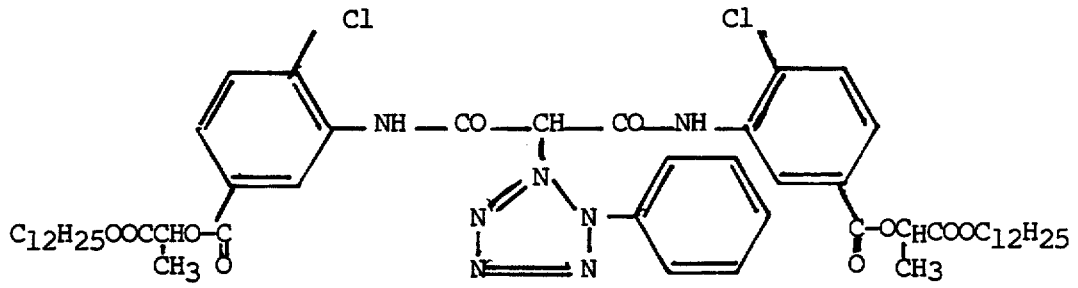

"

and insert:

—Yellow dye forming DIR Coupler K:

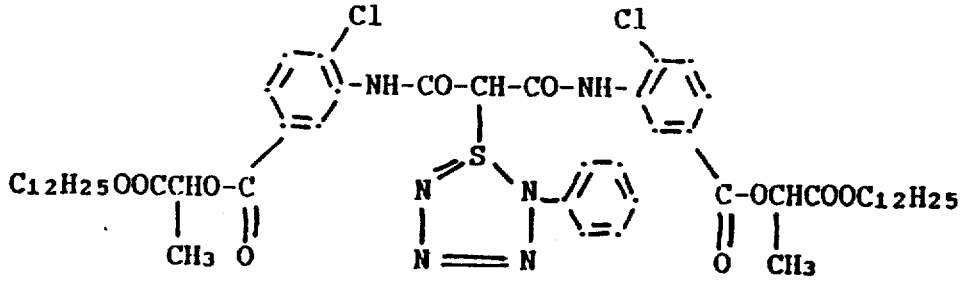

UNITED STATES PATENT AND TRADEMARK OFFICE

CERTIFICATE OF CORRECTION

PATENT NO. : 5,332,656

DATED : July 26, 1994

INVENTOR(S) : Bertoldi et al.

It is certified that error appears in the above-indentified patent and that said Letters Patent is hereby corrected as shown below:

Column 27, line 31, delete "(gainmaw)" and insert -- (gammaw) --.

Column 29, line 27, delete "croup" and insert --group--.

Column 30, top of page, formula (VIII) delete:

(VIII)

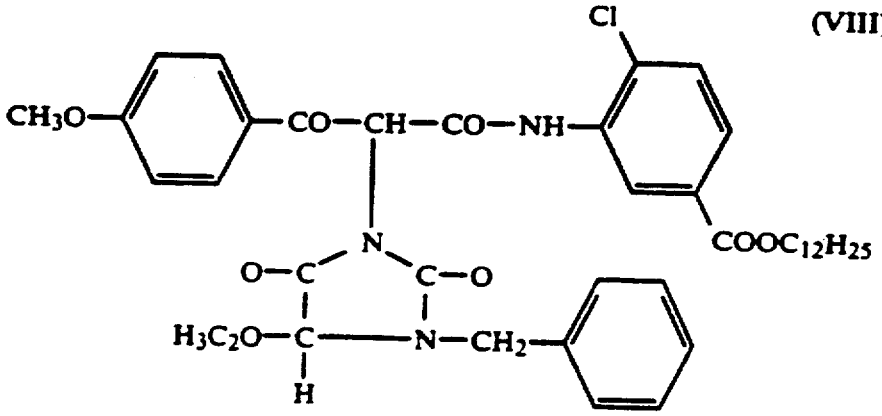

and insert:

UNITED STATES PATENT AND TRADEMARK OFFICE

CERTIFICATE OF CORRECTION

PATENT NO. : 5,332,656

DATED : July 26, 1994

INVENTOR(S) : Bertoldi et al.

It is certified that error appears in the above-indentified patent and that said Letters Patent is hereby corrected as shown below:

(VIII)

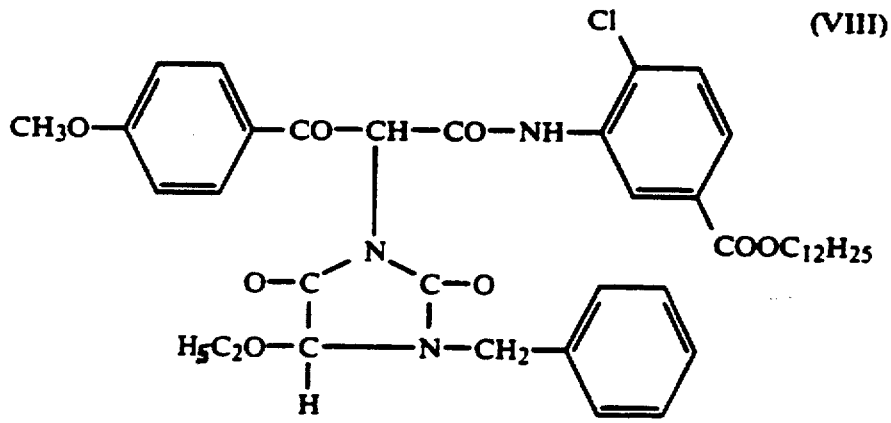

Signed and Sealed this

Twenty-fourth Day of January, 1995

*Attest:*

*Attesting Officer*

BRUCE LEHMAN

*Commissioner of Patents and Trademarks*